United States Patent [19]

Yarwood et al.

[11] Patent Number: 4,458,744

[45] **Date of Patent: * Jul. 10, 1984**

[54] ELECTROMAGNETIC CASTING SHAPE CONTROL BY DIFFERENTIAL SCREENING AND INDUCTOR CONTOURING

[75] Inventors: John C. Yarwood, Madison; Gary L. Ungarean, Woodbridge; Derek E. Tyler, Cheshire, all of Conn.; Gerhart K. Gaule, Elberon, N.J.

[73] Assignee: Olin Corporation, New Haven, Conn.

[ * ] Notice: The portion of the term of this patent subsequent to Mar. 30, 1999 has been disclaimed.

[21] Appl. No.: 297,440

[22] Filed: Aug. 28, 1981

Related U.S. Application Data

[60] Division of Ser. No. 96,763, Nov. 23, 1979, Pat. No. 4,321,959, which is a continuation-in-part of Ser. No. 56,463, Jul. 11, 1979, abandoned.

[51] Int. Cl.[3] ..... B22D 27/02

[52] U.S. Cl. ..... 164/503

[58] Field of Search ..... D6/85, 182, 191; 248/678, 146, 174; 206/512, 4 C; 164/503

[56] References Cited

U.S. PATENT DOCUMENTS

| | | |
|---|---|---|
| D.92,554 | 6/1934 | Pike . |
| 2,456,091 | 12/1948 | Stevens et al. . |
| 3,096,158 | 7/1963 | Gaule et al. . |
| 3,467,166 | 9/1969 | Getselev et al. . |
| 3,502,133 | 3/1970 | Carson . |
| 3,702,155 | 11/1972 | Getselev . |
| 3,985,179 | 10/1976 | Goodrich et al. . |
| 4,004,631 | 1/1977 | Goodrich et al. . |
| 4,135,568 | 1/1979 | Brooks . |
| 4,156,451 | 5/1979 | Getselev . |
| 4,158,379 | 6/1979 | Yarwood et al. . |
| 4,161,206 | 7/1979 | Yarwood et al. . |
| 4,215,738 | 8/1980 | Gaule et al. . |
| 4,216,817 | 8/1980 | Meier . |
| 4,236,570 | 12/1980 | Gaule et al. . |

FOREIGN PATENT DOCUMENTS

| | | |
|---|---|---|
| 462513 | 5/1973 | Australia . |
| 930925 | 7/1973 | Canada . |
| 2060637 | 6/1971 | Fed. Rep. of Germany . |
| 2902473 | 8/1979 | Fed. Rep. of Germany . |
| 338037 | 5/1977 | U.S.S.R. . |

*Primary Examiner*—Kuang Y. Lin

*Attorney, Agent, or Firm*—Howard M. Cohn; Paul Weinstein; Barry L. Kelmachter

[57] ABSTRACT

A method and apparatus for electromagnetic casting of metal and alloy ingots of desired shape having portions of small radius of curvature. A modified shield is provided which provides for a reduction of the electromagnetic field intensity at the corners of the forming ingot by increasing local screening of the field at the corners. Increased local screening at the corners is achieved by locally increasing shield depth, by providing for deeper displacement of the shield, by changing the shield section, or by changing the shield orientation. Also disclosed is a modified inductor which is shaped so as to be located at a greater distance from the portions of small radius of curvature of the ingots than from portions of the ingots adjacent to the portions of small radius of curvature. The modified shield may be combined with the modified inductor and/or with a coolant manifold to simultaneously modify and control coolant application elevation such that the elevation is a minimum at the corners of the ingot.

6 Claims, 24 Drawing Figures

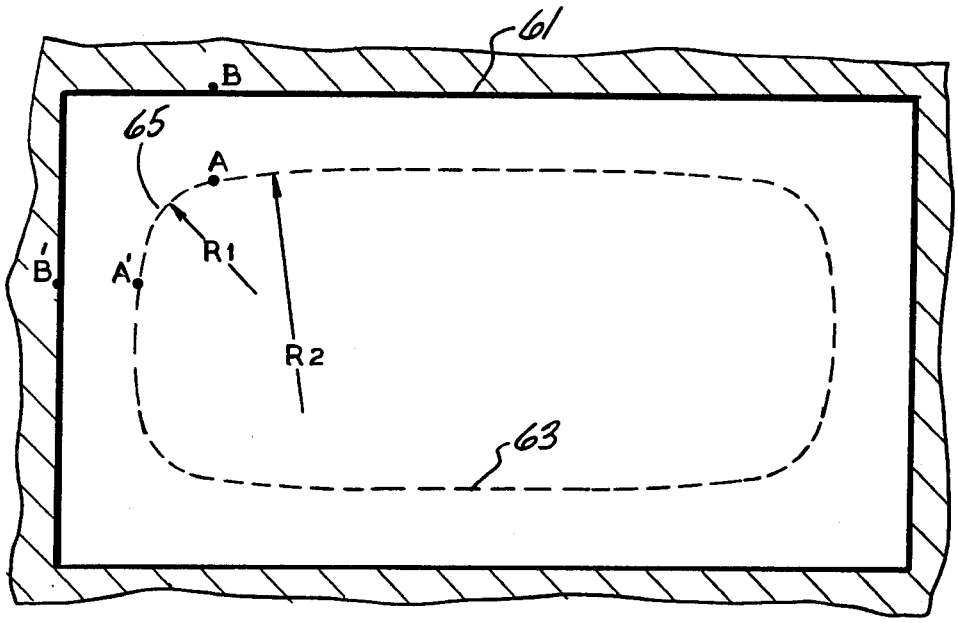
FIG-11 "PRIOR ART"
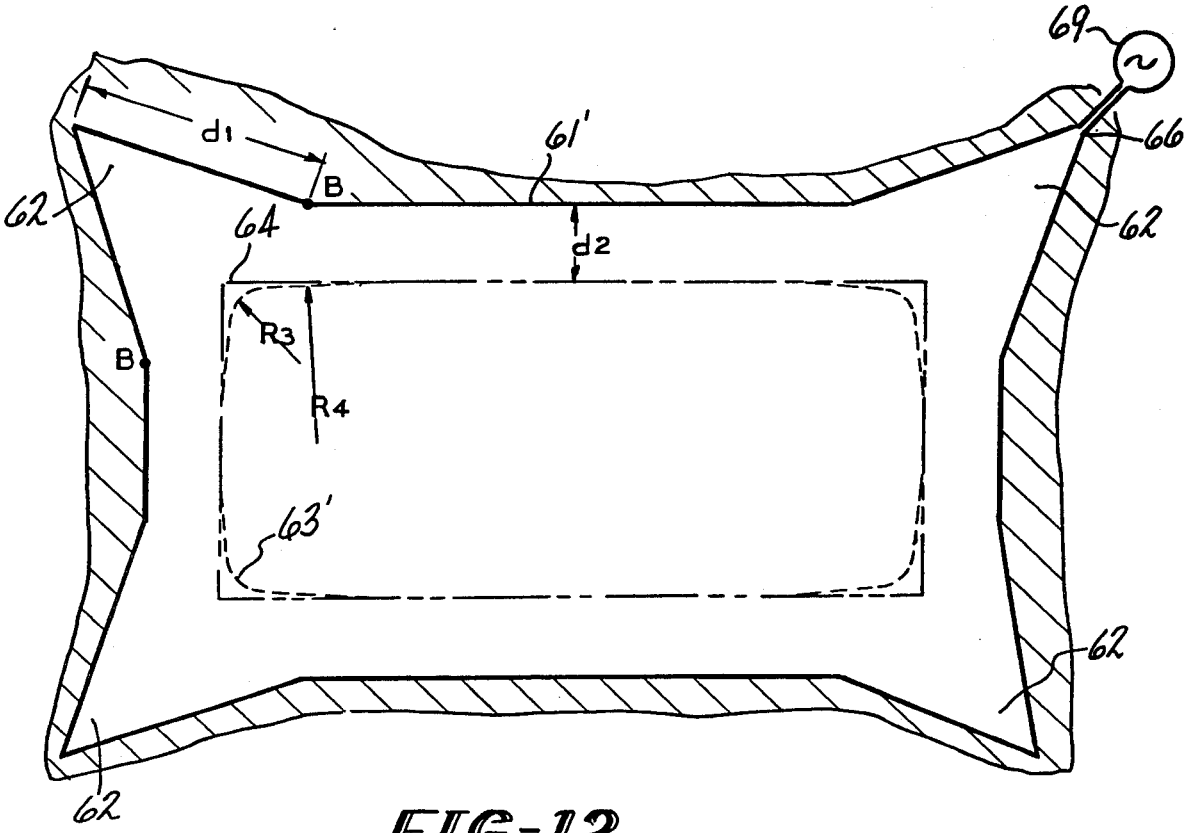
FIG-12

ELECTROMAGNETIC CASTING SHAPE CONTROL BY DIFFERENTIAL SCREENING AND INDUCTOR CONTOURING

CROSS REFERENCE TO RELATED APPLICATION

This application is a division of application Ser. No. 96,763, filed Nov. 23, 1979, now U.S. Pat. No. 4,321,959, which is a continuation-in-part of U.S. application Ser. No. 56,463 filed July 11, 1979 (now abandoned).

The application is also related to the following U.S. applications: U.S. application Ser. No. 921,298 (now U.S. Pat. No. 4,158,479), filed July 3, 1978 and U.S. application Ser. No. 957,420 filed on Nov. 2, 1978, (now abandoned) both entitled ELECTROMAGNETIC CASTING METHOD AND APPARATUS; U.S. application Ser. No. 1,730 filed on Jan. 8, 1979 entitled INGOT SHAPE CONTROL BY DYNAMIC HEAD IN ELECTROMAGNETIC CASTING; U.S. application Ser. No. 25,493 (now U.S. Pat. No. 4,215,738) filed Mar. 30, 1979 entitled ANTI-PARALLEL INDUCTORS FOR SHAPE CONTROL IN ELECTROMAGNETIC CASTING; and copending U.S. application Ser. No. 056,773 filed on July 11, 1979, (now abandoned) entitled CONTROLLED WATER APPLICATION FOR ELECTROMAGNETIC CASTING SHAPE CONTROL, all assigned to the assignee of the instant invention.

BACKGROUND OF THE INVENTION

This invention relates to an improved process and apparatus for control of corner shape in continuous or semi-continuous electromagnetic casting of desired shapes, such as for example, sheet or rectangular ingots of metal and alloys. The basic electromagnetic casting process had been known and used for many years for continuously or semi-continuously casting metals and alloys.

One of the problems which has been presented by electromagnetic casting of sheet ingots has been the existence of large radius of curvature corners thereon. Rounding off of corners in electromagnetic cast sheet ingots is a result of higher electromagnetic pressure at a given distance from the inductor near the ingot corners, where two proximate faces of the inductor generate a larger field. This is in contrast to lower electromagnetic pressure at the same distance from the inductor on the broad face of the ingot remote from the corner, where only one inductor face acts.

There is a need to form small radius of curvature corners on sheet ingots so that during rolling cross-sectional changes at the edges of the ingot are minimized. Larger radius of curvature corners accentuate tensile stress at the ingot edges during rolling which causes edge cracking and loss of material. Thus, by reducing the radius of curvature of the ingot at the corners there is a maximizing in the production of useful material.

It has been found in accordance with the present invention that rounding off of corners in electromagnetically cast ingots can be made less severe or of smaller radius by bringing about a net downward displacement of the screening current at the corners of a shield placed at the molten metal or alloy input end of the casting zone and/or by contouring the field producing inductor so as to enlarge the air gap between the inductor and the ingot at areas between the inductor and the ingot corners. Thus, since undesirable rounding off of the corners results from the action of excess electromagnetic force at the ingot corners, the desired modification of the field shape can be obtained by increased local screening of the field and/or by contouring the inductor at the corners.

Various embodiments of the present invention increase local screening of the electromagnetic field by locally increasing shield depth, by locally providing deeper displacement of the shield, or by certain local changes in shield section or orientation.

PRIOR ART STATEMENT

Known electromagnetic casting apparatus comprises a three part mold consisting of a water cooled inductor, a non-magnetic screen and a manifold for applying cooling water to the ingot being cast. Such an apparatus is exemplified in U.S. Pat. No. 3,467,166. to Getselev et al. Containment of the molten metal is achieved without direct contact between the molten metal and any component of the mold. Solidification of the molten metal is achieved by direct application of water from the cooling manifold to the forming ingot shell.

In some prior art approaches the inductor is formed as part of the cooling manifold so that the cooling manifold supplies both coolant to solidify the casting and to cool the inductor. See U.S. Pat. No. 4,004,631 to Goodrich et al.

Non-magnetic screens of the prior art are typically utilized to properly shape the magnetic field for containing the molten metal, as exemplified in U.S. Pat. No. 3,605,865 to Getselev. Another approach with respect to use of non-magnetic screens is exemplified as well in U.S. Pat. No. 3,985,179 to Goodrich et al. Goodrich et al. U.S. Pat. No. '179 describes the use of a shaped inductor in conjunction with a screen to modify the electromagnetic forming field.

It is generally known that during electromagnetic casting the solidification front between the molten metal and the solidifying ingot at the ingot surface should be maintained within the zone of maximum magnetic field strength, i.e. the solidification front should be located within the inductor. If the solidification front extends above the inductor, cold folding is likely to occur. On the other hand, if it recedes to below the inductor, a bleed-out or decantation of the liquid metal is likely to result. Getselev et al. U.S. Pat. No. '166 associate the coolant application manifold with the screen portion of the mold such that they are arranged for simultaneous movement relative to the inductor. In U.S. Pat. No. 4,156,451 to Getselev a cooling medium is supplied upon the lateral face of the ingot in several cooling tiers arranged at various levels longitudinally of the ingot. Thus, depending on the pulling velocity of the ingot the solidification front can be maintained within the inductor by appropriate selection of one of the tiers.

U.S. Pat. No. 4,158,379 and U.S. application Ser. No. 957,420 filed Nov. 2, 1978, describe adjustable and variable coolant application systems which control the portion of the solidification front at the surface of the casting without modifying the magnetic field.

Other approaches to improved ingot shape have included provisions of more uniform fields at conductor bus connections (Canadian Patent No. 930,925 to Getselev), and use of anti-parallel inductors between the main inductor and the faces of sheet ingots to control surface perturbations (U.S. application Ser. No. 25,493 (now U.S. Pat. No. 4,215,738) filed Mar. 30, 1979).

U.S. application Ser. No. 1,730 (now U.S. Pat. No. 4,236,570) filed Jan. 8, 1979 recognized that in electromagnetically casting rectangular or sheet ingots that the ingots are often cast with high radius of curvature ends or corners which is indicative of the need for improved ingot shape control at the corners of such ingots. The application discloses the use of a baffled hot top and/or a nozzle for providing increased directionality and increased dynamic head toward the ingot corners.

Finally, U.S. Pat. No. 3,502,133 to Carson teaches utilizing a sensor in a continuous or semi-continuous DC casting mold to sense temperature variations at a particular location in the mold during casting. The sensor controls application of coolant to the mold and forming ingot. Use of such a device overcomes instabilities with respect to how much extra coolant is required at start-up of the casting operation and just when or at what rate this excess cooling should be reduced. The ultimate purpose of adjusting the flow of coolant is to maintain the freeze line of the casting at a substantially constant location.

Carson U.S. Pat. No. '133 teaches that ingots having a width to thickness ratio in the order of 3 to 1 or more possess an uneven cooling rate during casting when coolant is applied peripherally of the mold in a uniform manner. To overcome this problem, Carson U.S. Pat. No. '133 applies coolant to the wide faces of the ingot or/and the mold walls and not at all (or at least at a reduced rate) to the relatively narrow end faces of the ingot or/and the mold walls.

All patents and applications described herein are intended to be incorporated by reference.

SUMMARY OF THE INVENTION

The present invention comprises a process and apparatus for electromagnetic casting of metals and alloys into rectangular or sheet ingots and other desired elements of shape control, having small radius of curvature corners or portions by modification of the electromagnetic field. In particular, a method and apparatus utilizing control or shaping of the magnetic field by means of controlled or differential field screening, particularly at the corners of rectangular ingots or other desired elements of shape is claimed. Control and shaping of the magnetic field by means of contouring of the electromagnetic inductor is also claimed.

In a further embodiment, control or shaping of the magnetic field by differential screening and/or by inductor contouring is combined with contoured impingement of a coolant about the surface of the ingot being cast such that the impinging coolant contacts the ingot at a minimum peripheral elevation at or near the corners of the forming ingot.

According to the present invention, the desired modification of the field shape can be obtained by inductor contouring and/or by increased local screening of the electromagnetic field at the ingot corners, thereby making the rounding off of corners in electromagnetic cast ingots less severe or of smaller radius.

In accordance with one embodiment of this invention, a desired modification of the electromagnetic field is obtained by contouring the inductor so as to enlarge the gap between the inductor and the ingot at the ingot corners.

In accordance with another embodiment of this invention, increased local screening of the electromagnetic field at the ingot or desired shape corners is achieved by locally increasing the shield depth at the corners.

In accordance with another preferred embodiment of this invention, increased local screening of the electromagnetic field at the desired shape or ingot corners is achieved by locally deeper displacement of the shield section at the corners.

In accordance with another embodiment of this invention, increased local screening is accomplished by locally changing the shield cross-section at the corners of the ingot or desired shape.

In accordance with yet another embodiment of this invention, increased local screening of the electromagnetic field at the ingot corners is achieved by locally altering the orientation of the shield at the ingot corners.

All of the aforementioned screening embodiments of this invention operate via a net downward displacement of the screening current at the corners of the shield. It is of course understood that hybrids of locally increased shield depth, locally deeper displacement of the shield, local changes in shield cross-section and local changes in shield orientation can also be utilized in accordance with the concepts of this invention.

Other embodiments of this invention contemplate the combining of the various modified screens with a contoured inductor and/or with a coolant manifold such that the effects of field control are enhanced by increased static head at the ingot corners brought about by impingement of coolant at a lower elevation at or near the corners of the ingot.

Accordingly, it is an object of this invention to provide an improved process and apparatus for electromagnetic casting of metals and alloys into sheet ingots, or other desired elements of shape control, characterized by small radius of curvature corners or portions thereon.

This and other objects will become more apparent from the following description and drawings.

BRIEF DESCRIPTION OF THE DRAWINGS

FIG. 3(*b*) is a partial section through the face of the shield of FIG. 3(*a*) showing the shield positioned between an inductor and an ingot being cast. FIG. 3(*c*) is a partial section through the corner of the shield, inductor and ingot of FIG. 3(*b*).

FIG. 4(*b*) is a partial section through the face of the shield of FIG. 4(*a*) showing the shield positioned between an inductor and an ingot being cast. FIG. 4(*c*) is a partial section through the corner of the shield, inductor and ingot of FIG. 4(*b*).

FIG. 5(*b*) is a partial section through the face of the shield of FIG. 5(*a*) showing the shield positioned between an inductor and an ingot being cast. FIG. 5(*c*) is a partial section through the corner of the shield, inductor and ingot of FIG. 5(*b*). FIG. 5(*d*) is a bottom view of the shield of FIG. 5(*a*).

FIG. 6(*b*) is a partial section through the face of the shield of FIG. 6(*a*) showing the shield positioned between an inductor and an ingot being cast. FIG. 6(*c*) is a partial section through the corner of the shield, inductor and ingot of FIG. 6(*b*).

FIG. 11 is a partial top view showing the isoflux line contour for a prior art rectangular inductor.

FIG. 12 is a partial top view showing the isoflux line contour for a contoured inductor in accordance with one embodiment of this invention.

DETAILED DESCRIPTION OF PREFERRED EMBODIMENTS

In all drawing figures alike parts are designated by alike numerals.

Figure 1:
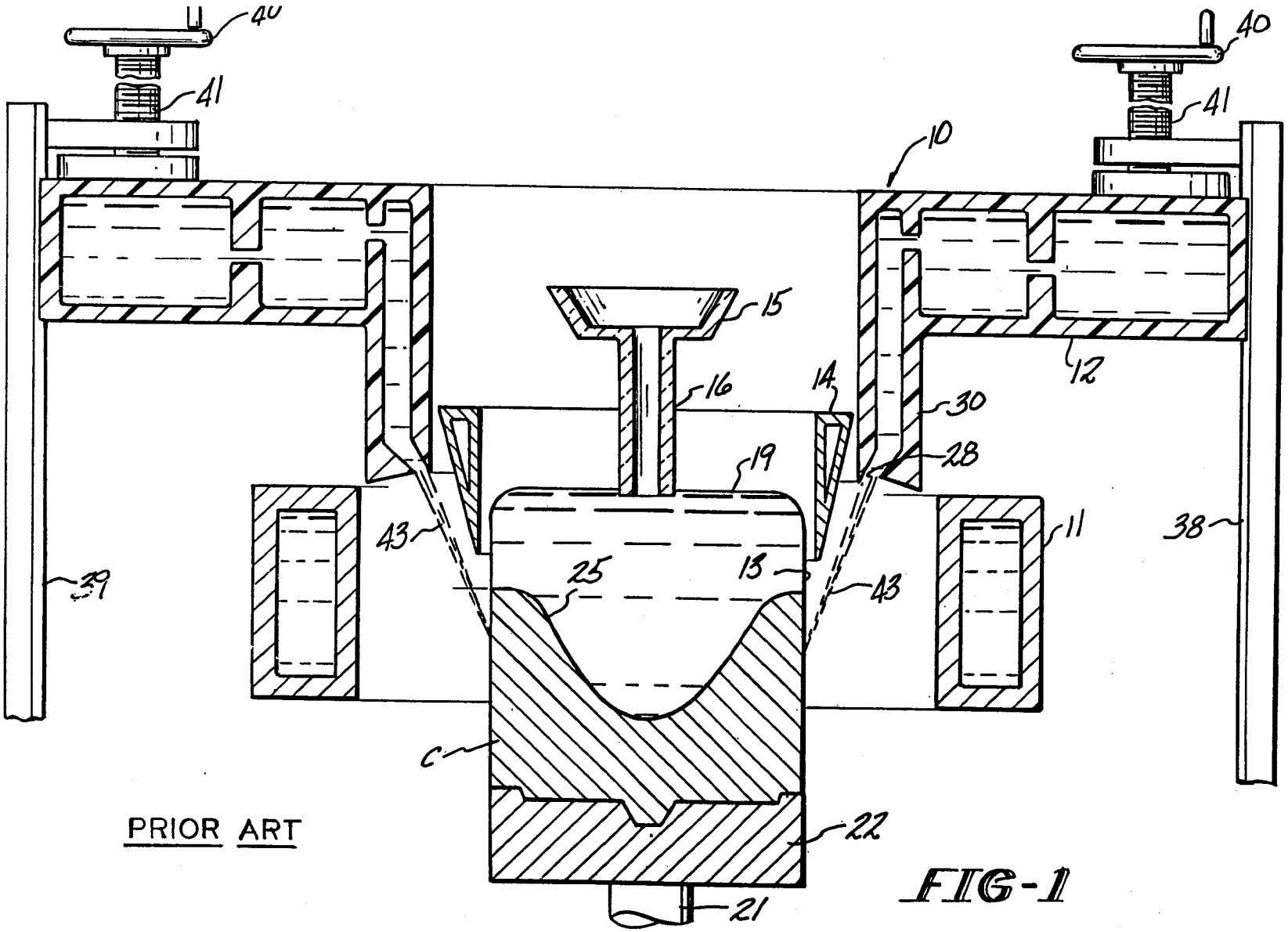
FIG-1 PRIOR ART
FIG. 1 is a schematic cross-sectional representation of a prior art electromagnetic casting apparatus utilizing a uniform depth, cross-section and orientation non-magnetic shield.

Referring now to FIG. 1, there is shown therein a prior art electromagnetic casting apparatus in accordance with U.S. Pat. No. 4,158,479.

The electromagnetic casting mold 10 is comprised of an inductor 11 which is water cooled; a coolant manifold 12 for applying cooling water to the peripheral surface 13 of the metal being cast C; and a non-magnetic screen 14. Molten metal is continuously introduced into the mold 10 during a casting run, in the normal manner using a trough 15 and down spout 16 and conventional molten metal head control. The inductor 11 is excited by an alternating current from a suitable power source (not shown).

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross-section.

An air gap exists during casting, between the molten metal head 19 and the inductor 11. The molten metal head 19 is formed or molded into the same general shape as the inductor 11 thereby providing the desired ingot cross-section. The inductor extends transversely about the molten material and may have any known standard shape including circular or rectangular as required to obtain the desired ingot C cross-section, but may also in accordance with this invention be given a specific contour as depicted for example in FIGS. 12, 13, and 14.

The purpose of the non-magnetic screen 14 is to fine tune and balance the magnetic pressure with the hydrostatic pressure of the molten metal head 19. The non-magnetic screen 14 comprises a separate element as shown and is not a part of the manifold 12 for applying the coolant.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. The water is shown applied to the ingot surface 13 within the confines of the inductor 11. The water may be applied, however, to the ingot surface 13 from above, within or below the inductor 11 as desired.

The solidification front 25 of the casting comprises the boundary between the molten metal head 19 and the solidified ingot C. The location of the solidification front 25 at the ingot surface 13 results from a balance of the heat input from the superheated liquid metal 19 and the resistance heating from the induced currents in the ingot surface layer, with the lcngitudinal heat extraction resulting from the cooling water application.

Coolant manifold 12 is arranged above the inductor 11 and includes at least one discharge port 28 at the end of extended portion 30 for directing the coolant against the surface 13 of the ingot or casting. The discharge port 28 can comprise a slot or a plurality of individual orifices for directing the coolant against the surface 13 of the ingot C about the entire periphery of that surface.

Coolant manifold 12 is arranged for movement along vertically extending rails 38 and 39 axially of the ingot C such that extended portion 30 and discharge port 28 can be moved between the non-magnetic screen 14 and the inductor 11. Axial adjustment of the discharge port 28 position is provided by means of cranks 40 mounted to screws 41.

The coolant is discharged against the surface of the casting in the direction indicated by arrows 43 to define the place of coolant application.

Figure 2:
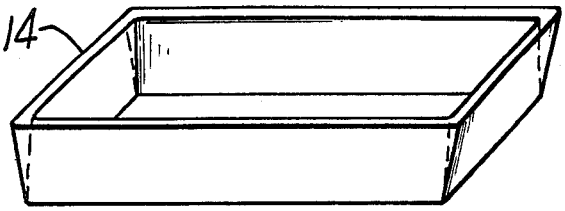
PRIOR ART FIG-2
FIG. 2 is a perspective view of the prior art non-magnetic shield of FIG. 1.

FIG. 2 shows a prior art screen 14 of constant height and section as shown in FIG. 1. Rounding off of corners in electromagnetic casting of rectangular ingots and other shapes having corners from higher electromagnetic pressure at a given distance from the inductor near the corners, where two proximate faces of the single turn inductor generate field, as compared to the pressure at the same distance from the inductor on the broad faces of the ingot or other shapes remote from the corner, where only one inductor face acts. Solution to the problem may be sought in accordance with this invention through electromagnetic field modification. This invention relates to a method and apparatus which is utilized to control or shape the magnetic field by means of controlled or differential field screening, particularly at the corners of rectangular ingots.

Use of screens for field modification such as shown in FIGS. 1 and 2 is known in the art. Getselev U.S. Pat. No. '865 describes a screen or shield in the form of a closed ring positioned within the inductor with its lower edge located approximately at the level of half of the height of the inductor. The thickness of this shield is changed along its height in an axial or vertical direction to obtain a balance between the hydrostatic pressure and the electromagnetic forces while maintaining a vertical side wall on the liquid immediately above the solidification front. This technique is designed to prevent formation of a wave-shaped ingot surface due to variations in its transverse dimensions. Accordingly, shaping in this form of screening is restricted to control of the liquid contour along the vertical or longitudinal axis of the longitudinally extending casting. No consideration is given to shaping in the horizontal axis such as could be used in a casting having a desired shape with at least one transverse portion of the outer peripheral surface extending transversely to the longitudinal axis and having a small radius of curvature, such as for example, the corner definition in casting of rectangular ingots.

Since rounding off of ingot and other casting shape corners results to a large extent from the action of excess electromagnetic force at the corner, the desired modification of the field shape can be obtained by increased local screening of the field at the corner. In accordance with this invention, increased local screening can be achieved by locally increased shield depth, by locally deeper displacement of the shield, by locally changing the shield section, or by locally changing shield orientation. All of the above embodiments operate via a net downward displacement of the screening current at the corners of the shield.

Figure 3A:
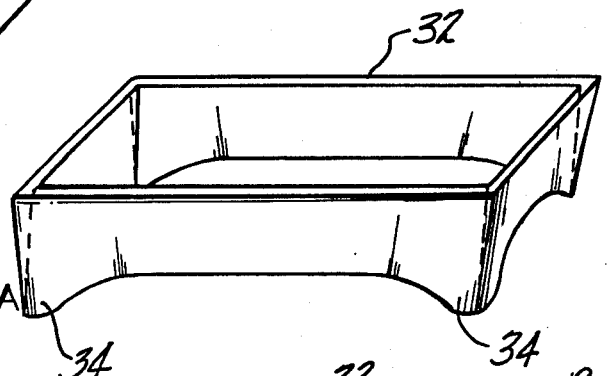
FIG. 3(*a*) is a perspective view of a non-magnetic shield in accordance with this invention showing increased local depth of the shield at the corners.
Figure 3B:
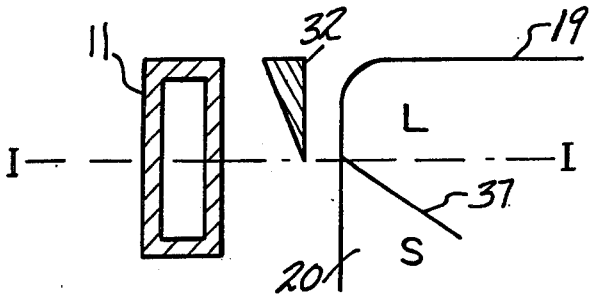
Figure 3C:
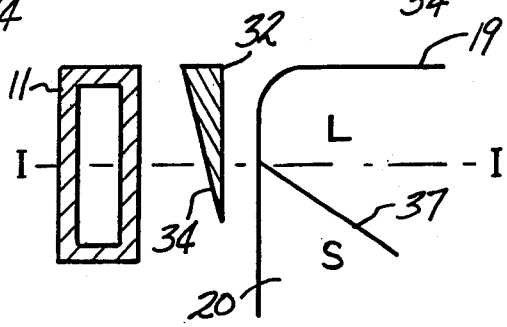

FIG. 3(*a*) shows a non-magnetic shield or magnetic field reducing screen in accordance with the present invention. The screen comprises a substantially closed loop extending transversely about a longitudinal axis. The loop has a substantially uniform cross-section. Shield 32 is provided with areas 34 of greater depth in the direction of the longitudinal axis at the corners. FIG. 3(*b*) shows a partial section through a face of inductor 11, screen 32, and ingot 20 while FIG. 3(*c*) shows a partial section through a corner of these elements. For reference purposes elevation I—I is shown passing through the critical point where liquid (L)—solid (S) front 37 intersects the periphery of ingot 20. It can be seen that at the ingot corners, FIG. 3(*c*), screen 32 projects a greater depth with respect to elevation I—I than does the remainder of the screen along the faces of ingot 20, FIG. 3(*b*). This greater screen depth at the ingot corners causes the reducing or screening of more electromagnetic field from the ingot 20 at elevation I—I at the corners than along the faces of ingot 20.

Figure 4A:
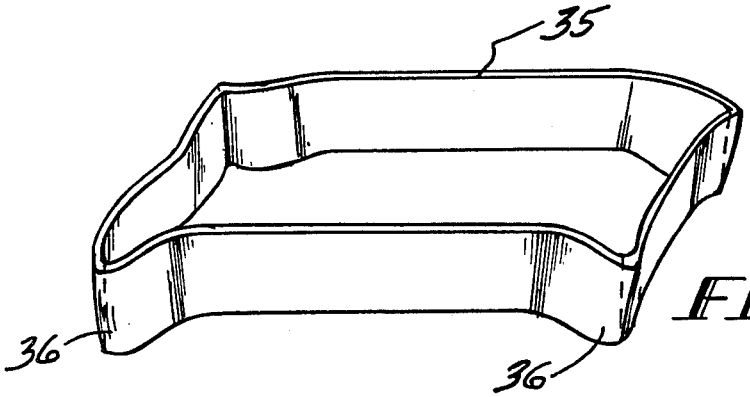
FIG. 4(*a*) is a perspective view of a non-magnetic shield in accordance with another embodiment of this invention showing areas of locally deeper displacement of the shield at the corners.
Figure 4B:
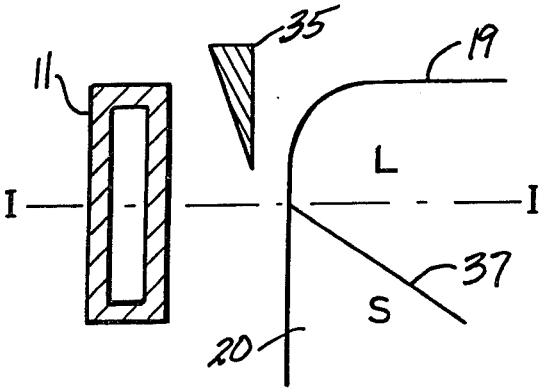
Figure 4C:
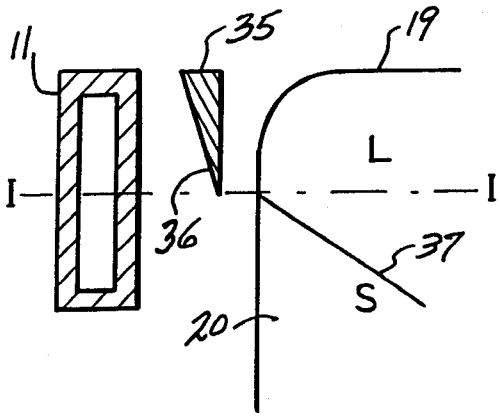
Figure 5A:
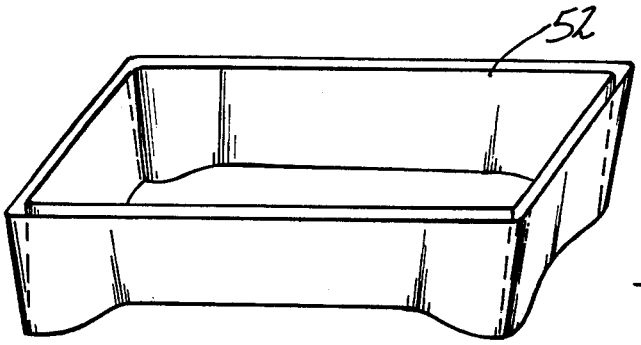
FIG. 5(*a*) is a perspective view of a non-magnetic shield in accordance with another embodiment of this invention showing areas of locally inclination to the screen axis at the corners.
Figure 5D:
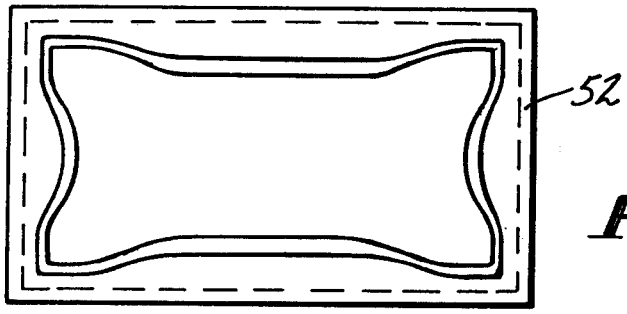
Figure 5B:
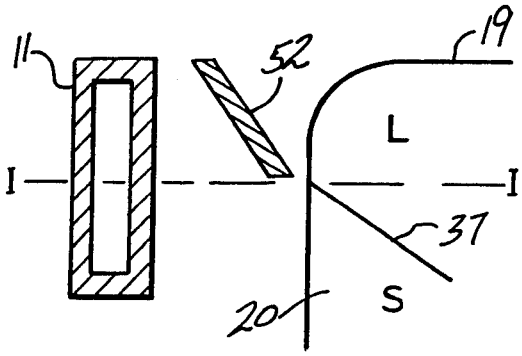
Figure 5C:
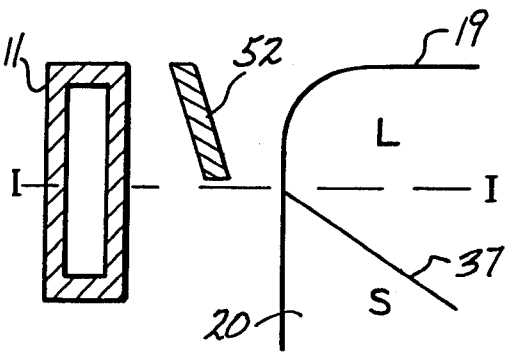
Figure 6A:
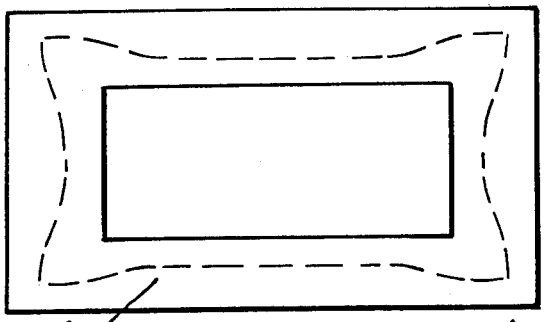
FIGS. 6(*a*) and 6(*d*) are top and bottom views, respectively, of a non-magnetic shield in accordance with another embodiment of this invention showing a shield of tapered section having increased thickness at the bottom of the screen corners.
Figure 6D:
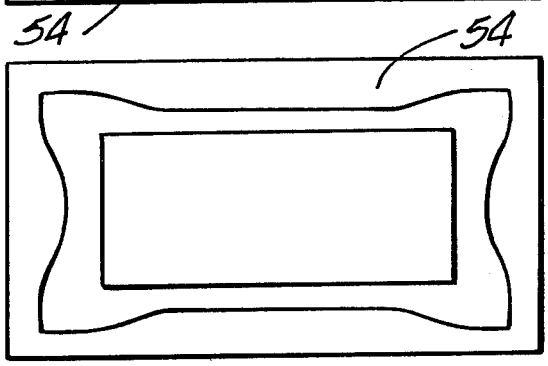
Figure 6B:
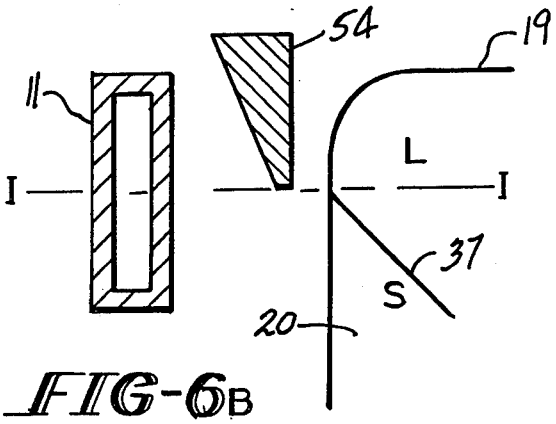
Figure 6C:
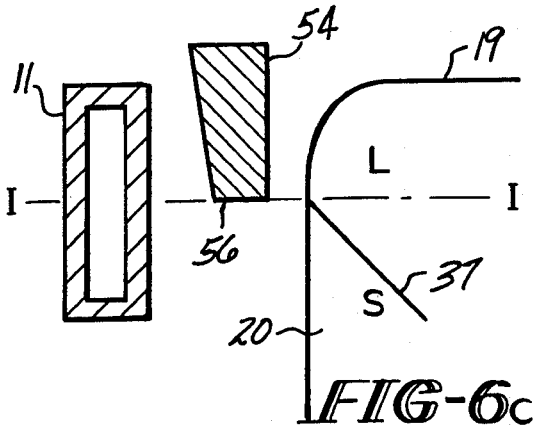

FIG. 4(*a*) shows a modification of the screen depicted in FIG. 3(*a*). Screen 35 is provided with greater depth 36 at the corners by displacement of the whole screen section downward in the direction of the longitudinal axis at the corner locations. FIG. 4(*b*) shows a section through a face of inductor 11, screen 35 and ingot 20, while FIG. 4(*c*) shows a section through the corner of these elements. The greater depth 36 of screen 35 as can be seen in FIG. 4(*c*) provides further enhanced screening at elevation I—I at the corners of ingot 20 than through the broad face depicted in FIG. 4(*b*).

FIGS. 5(*a*) and 5(*d*) illustrate another embodiment of this invention. Screen 52 is an inclined member of constant section having a lower angle of inclination at the corners with respect to the longitudinal axis 29 of ingot 20 and the screen. As can be seen from FIG. 5(*b*), a section through the face of ingot 20, inductor 11, and screen 52, and FIG. 5(*c*), a section through the corner of these elements, the base of screen 52 nearest to elevation I—I is closest to inductor 11 at the corner of ingot 20. The closer a shield is to an inductor the more current is induced in the shield. Thus, the change in shield angle at the corners modulates the containment field at and near elevation I—I at the ingot corner depicted in FIG. 5(*c*) more than along the ingot faces depicted by FIG. 5(*b*).

A further embodiment of a screen which can be utilized in accordance with this invention to provide modified screening at the ingot corners is depicted in FIGS. 6(*a*) through (*d*). Screen 54 is a tapered section along the faces of the ingot 20 (FIG. 6(*b*)). However, screening of the corner at and near elevation I—I is increased by increasing the screen thickness of a transverse cross-section at the bottom 56 of screen 54 as compared to portions of the screen adjacent the corner as shown in section in FIG. 6(*c*). If necessary, the angle of taper can be reduced to zero.

Solution to the problem of rounded off corners caused by higher electromagnetic pressure near and at ingot corners in electromagnetic casting may also be sought through metal head or pressure modification. Reference is made to the aforementioned copending U.S. application Ser. No. 56,773, (now abandoned) the disclosure of which is hereby incorporated by reference. In accordance with the disclosure of U.S. application Ser. No. 56,773, (now abandoned) rounding off of corners in electromagnetic casting results in part from higher electromagnetic pressure near and at the corners of the forming ingot and in part from excess cooling or higher heat extraction rates at the corners as a result of geometric and higher heat transfer characteritics.

Prior art uniform rate and height peripheral coolant flow directed at the surface of a forming ingot leads to excess cooling at ingot corners and results in the solidification front rising at the corners of the ingot as compared to the position of the solidification front along the faces of the forming ingot. Stated another way, the height of the solidification front from the point of coolant impingement at the corners of a uniformly cooled electromagnetically cast ingot is greater than the height of the solidification front from point of coolant impingement along the faces of the forming ingot. Thus, the combination of higher solidification front (lower head) and increased magnetic pressure at the corners of the forming ingot causes the pushing of molten metal or alloy away from the corners leading to a highly undesirable rounding off of the corners.

In accordance with the disclosure in U.S. application Ser. No. 56,773, (now abandoned) control of coolant application is utilized to produce controlled differential static head to thereby obtain refinement of ingot shapes at the corners, and in particular to form smaller radius of curvatures at ingot corners. This control is effected by selection of the rate and/or location of cooling water application to forming ingot shells. Rounding off of corners in electromagnetic casting can be made less severe or of smaller radius by contouring the water application rate and/or elevation so that the rate and/or elevation is a minimum at the corners of the ingot. Reduction of the water application rate and/or lowering of the application level serves to reduce the local heat extraction rate along an ingot transverse cross-section line of constant height. This in turn lowers the position of the solidification front at the ingot corner and correspondingly raises the metal static head or pressure at the corner. This increased pressure results in the liquid metal approaching the inductor more closely at the corner and thus filling the corner to form a smaller radius of curvature at the corner before the increased static pressure is counterbalanced by the increased electromagnetic force.

In a further embodiment of this invention, aspects of two solutions to rounding off of ingot corners, namely solution through electromagnetic field modification utilizing modified screens and solution through metal head or pressure modification by coolant control are combined in one apparatus and process. FIGS. 7 through 10 depict utilization of the modified screens of this invention in conjunction with or as part of a coolant manifold.

Figure 7:
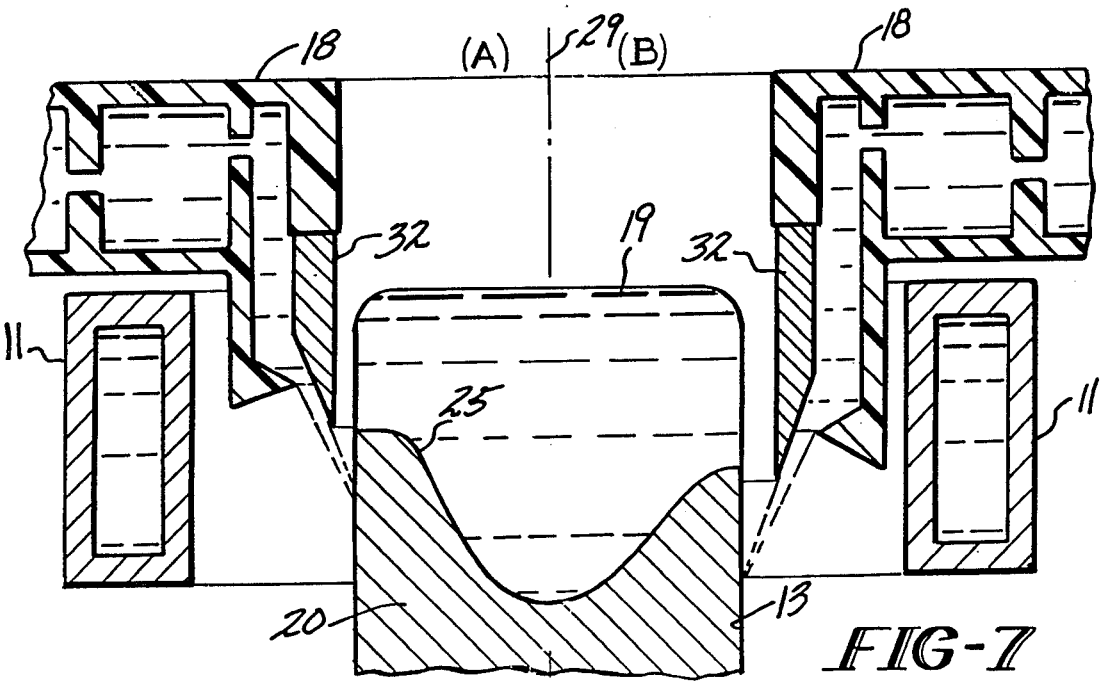
FIG. 7 is a partial schematic cross-sectional representation of the shield of FIG. 3(*a*) being utilized as part of a coolant manifold in an electromagnetic casting apparatus.
Figure 8:
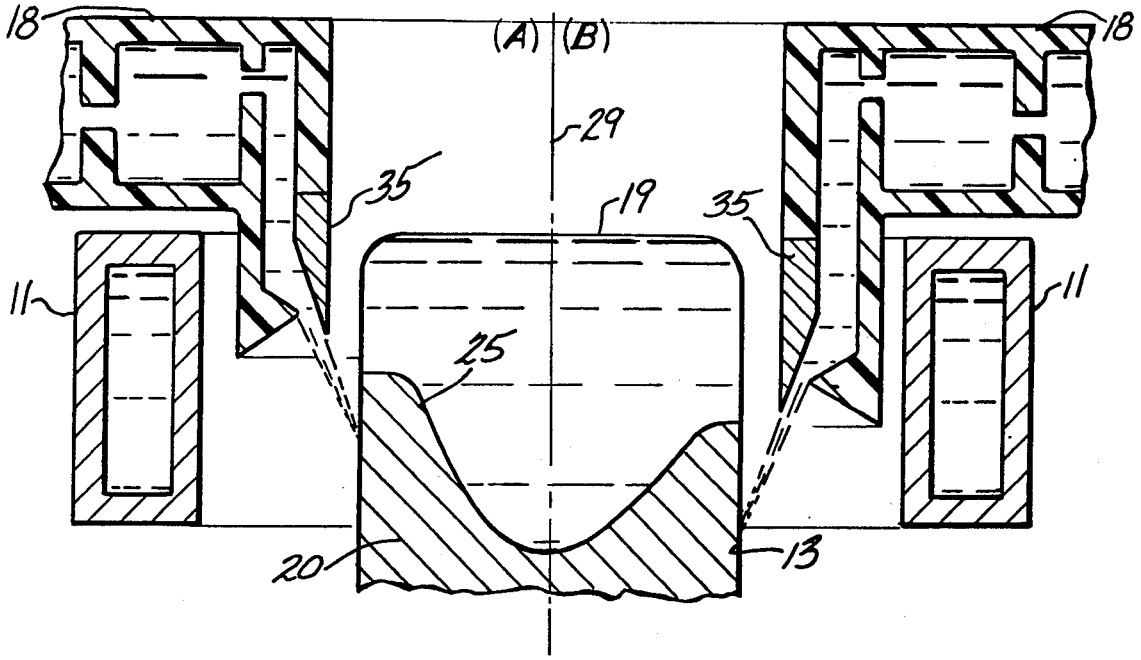
FIG. 8 is a partial schematic cross-sectional representation of the shield of FIG. 4(*a*) being utilized as part of a coolant manifold in an electromagnetic casting apparatus.

FIGS. 7 and 8 show screens 32 (FIG. 3(*a*)) and 35 (FIG. 4(*a*)) utilized as a part of or as an element of coolant manifolds 18. Line 29 divides FIGS. 7 and 8 into sides (A) and (B), (A) being a partial section through a face of the ingot 20, the inductor 11 and manifold 18, while shield (B) represents a partial section through a corner of these elements. It can be seen that screens 32 and 35, when utilized as a part of coolant manifolds 18, serve the dual function of modifying and reducing the magnetic field at the corners of ingot 20 while simultaneously causing a lowering of the elevation of impingement of coolant on the surface 13 of ingot 20, thereby lowering the soldification front 25 at the corners of ingot 20. In accordance with the principles discussed hereinbefore, the combination of higher metal static head 19 and lower electromagnetic field at the corners of ingot 20 bring about added corner shaping and a reduction of the radius of curvature at the ingot corners.

Figure 9:
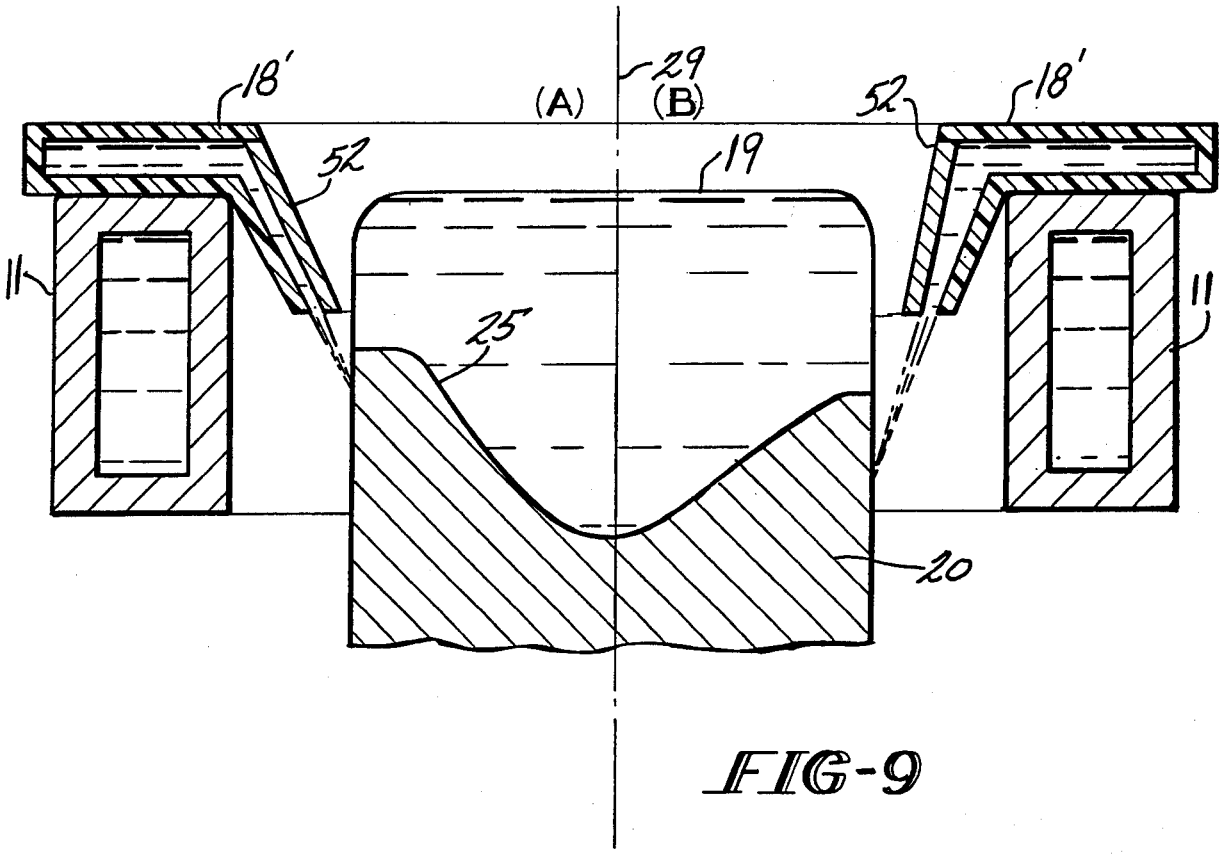
FIG. 9 is a partial schematic cross-sectional representation of the shield of FIG. 5(*a*) being utilized as part of a coolant manifold in an electromagnetic casting apparatus.

FIG. 9 shows screen 52 (FIG. 5(*a*)) utilized as part of or as an element of coolant manifold 18'. Again, screen 52 is utilized as a part of manifold 18' to direct coolant flow at the surface 13 of ingot 20 such that the effects of increased screening at the corners, side (B), would be enhanced by the lower elevation of water impingement on the surface of the ingot corner. The lower elevation of impingement of coolant at the ingot corners is brought about as a result of the shallow angle of screen 52 to the ingot surface at the corners thereof.

Figure 10:
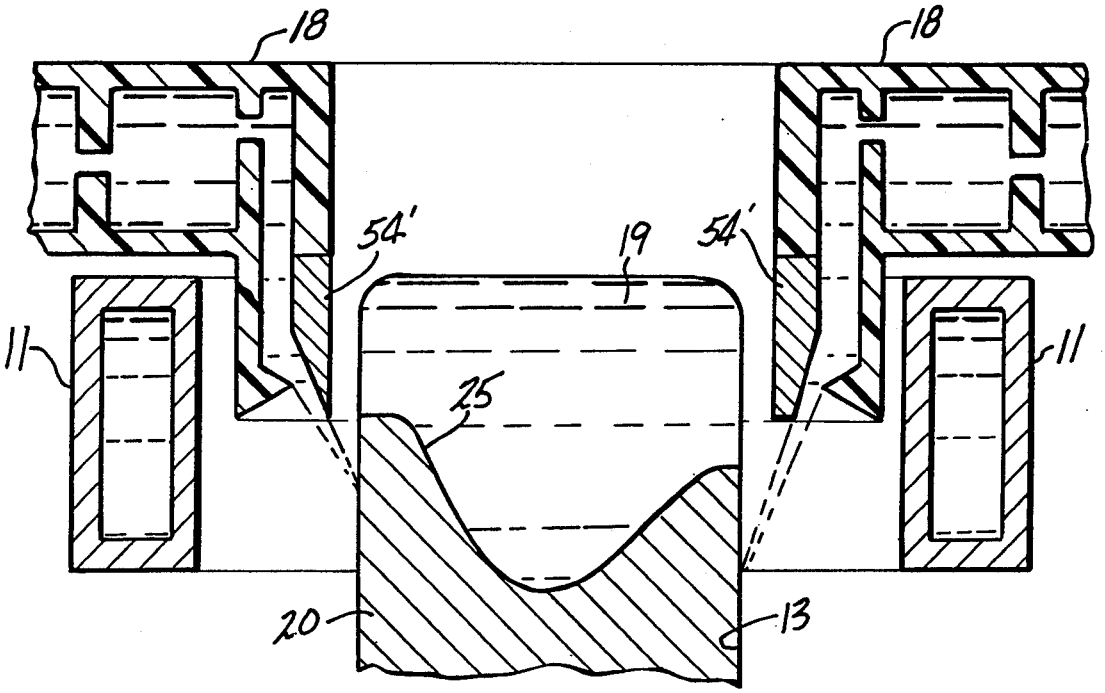
FIG. 10 is a partial schematic cross-sectional representation of a shield similar to the shield depicted in FIGS. 6(*a*)–(*d*) being utilized as part of a coolant manifold in an electromagnetic casting apparatus.

Finally, FIG. 10 depicts a slight variation of the screen depicted in FIGS. 6(*a*) through 6(*d*) utilized as part of a coolant manifold 18. Screen 54' directs coolant at ingot surface 13 at a lower elevation at the corners (side B) than at the broad faces of ingot 20 (side A). Thus, increased screening at the corners is enhanced by the lower elevation of coolant impingement and consequent lowering of solidification front 25 at the ingot corners.

As an alternative or in addition to lower elevation coolant impingement, the manifold and screens of this invention could be combined so as to deliver a lower rate of coolant application, including a zero rate at the corners of the ingot. As disclosed in copending U.S. application Ser. No. 56,773, (now abandoned) such a lower rate also leads to a lowering of the solidification front at the corners of the forming ingot leading to formation of corners having a smaller radius of curvature.

The manifolds of this invention are typically constructed of non-metallic materials such as plastics, in particular reinforced phenolics, while the screens in accordance with this invention are typically constructed of a non-magnetic metal such as for example austenitic stainless steel.

In accordance with another aspect of the present invention, it has been found possible to reduce and control corner radius in electromagnetically cast ingots by inductor shaping. When an ingot is being cast with an electromagnetic mold, the ingot will assume whatever shape is necessary to balance the hydrostatic pressures against the containment force. The containment force at any point is given by the vector product of the field (B) and the induced current density (J), i.e. the force is $B \times J$. Thus, that component $B_c$ of the vector B which contributes to the containment force is herein denoted containment field. Since the current density (J) is induced by the field (B), the containment force is roughly proportional to $B_c^2$. Accordingly, to a first approximation a load with uniform head at equilibrium in an EM mold will have a uniform $B_c$ field around its perimeter at some elevation Z above the solidification front. Whatever shape the lines of constant containment field map the load will conform to. Where the contours of containment field $B_c$ map into a rectangle, so will the load. An exception to this general rule is found when a corner of radius less than the penetration depth ($\delta$) exists. Here, current tends to short circuit the corner. Hence, at and near the corner J is reduced below what would be expected from the magnitude of the $B_c$ field, and the force $B_c \cdot J$ is also reduced causing a further bulging effect. This bulging tends to further reduce the corner radius.

In accordance with this aspect of the present invention in order to improve the corner shape of the containment field contour lines, it is necessary to change the shape of the inductor in the vicinity of that corner. The shape of the inductor may include at least one transversely extending portion which is recessed as compared to adjacent transversely extending portions to provide reduced containment force at the peripheral surface of the casting in the recessed transverse portion of the containment force field. Also, the reduced containment force field is arranged to form the corner or transverse portion of the outer peripheral surface of the casting having a small radius of curvature.

FIG. 11 shows a containment field contour for a typical rectangular inductor, the inside surface 61 of which is shown in the drawing. As can be seen from the plot, the containment contour line 63 in the vicinity of a corner, for example corner 65, can be characterized by a curve with a major and minor radii, $R_1$ and $R_2$, respectively. Points A-A' mark the intersection of the two curves formed by $R_1$ and $R_2$ and serve as the reference for basic modification of the inductor. Points B-B' on the inductor face are opposite Points A-A'. By changing the shape of the inductor to the shape of inductor 61' illustrated in FIG. 12, wherein the inductor corners 62 are provided with a generally triangular cross-section, $R_1$ can be significantly reduced with the containment contour 63' more closely approaching the ideal containment contour 64. As the parametric ratio $d_1/d_2$, with $d_2$ being the normal air gap, increases, $R_3$ decreases asymptotically. By adjusting the break points B-B' along the axis and adjusting the radius $d_1/d_2$, corners with various degrees of curvature can be obtained.

Figure 13:
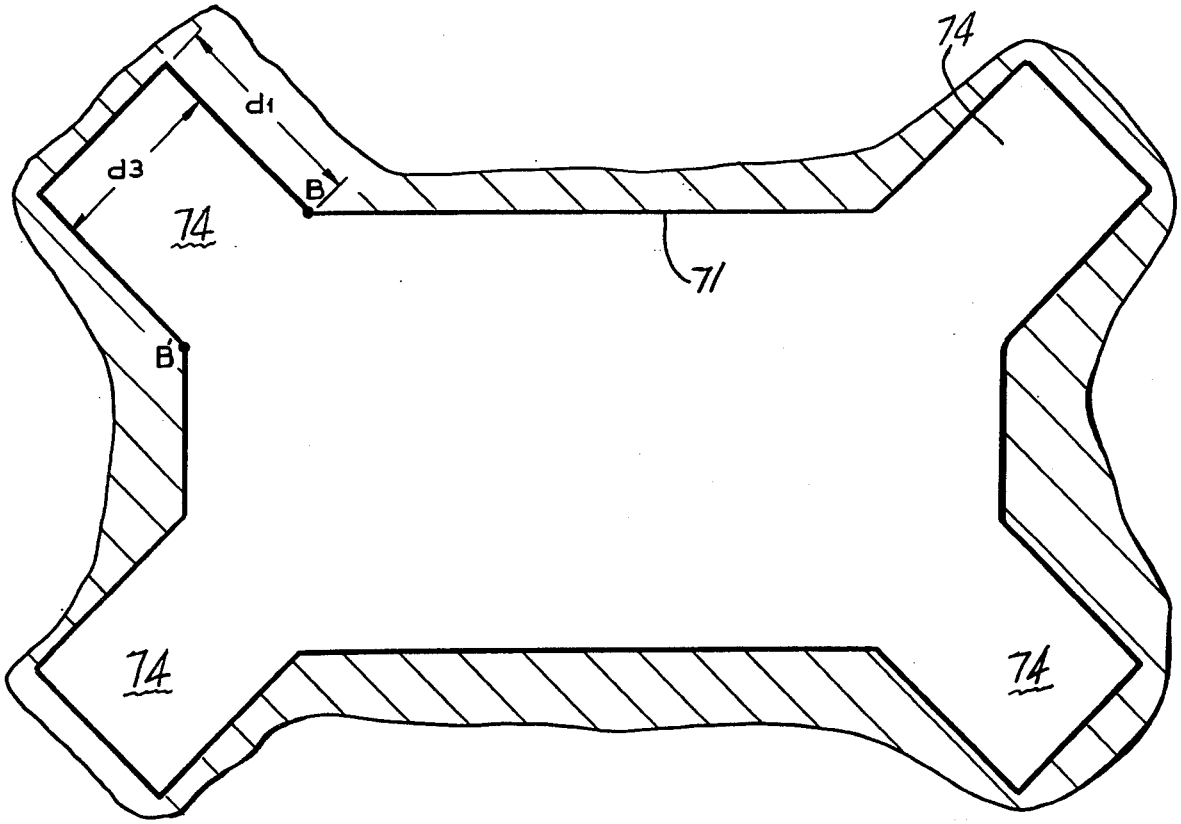
FIG. 13 is a partial top view showing a contoured inductor in accordance with another embodiment of this invention.

To reduce the corner radii $R_3$ in FIG. 12 beyond its asymptotic limit, an additional modification to the inductor corner is necessary. Such a modification is shown in FIG. 13 wherein an inductor inside surface 71 indicates the general shape of such a modified inductor. In this modification the inductor corners 74 are provided so as to have a generally rectangular shaped cross-section. Again, the parameters $d_1$, $d_3$, and B–B' are a function of the normal air gap $d_2$ desired and the ingot geometry. The asymptotic limit of load corner radii of this modification appears to be nearly an order of magnitude better than for the unmodified prior art inductor 61 depicted in FIG. 11.

Figure 14:
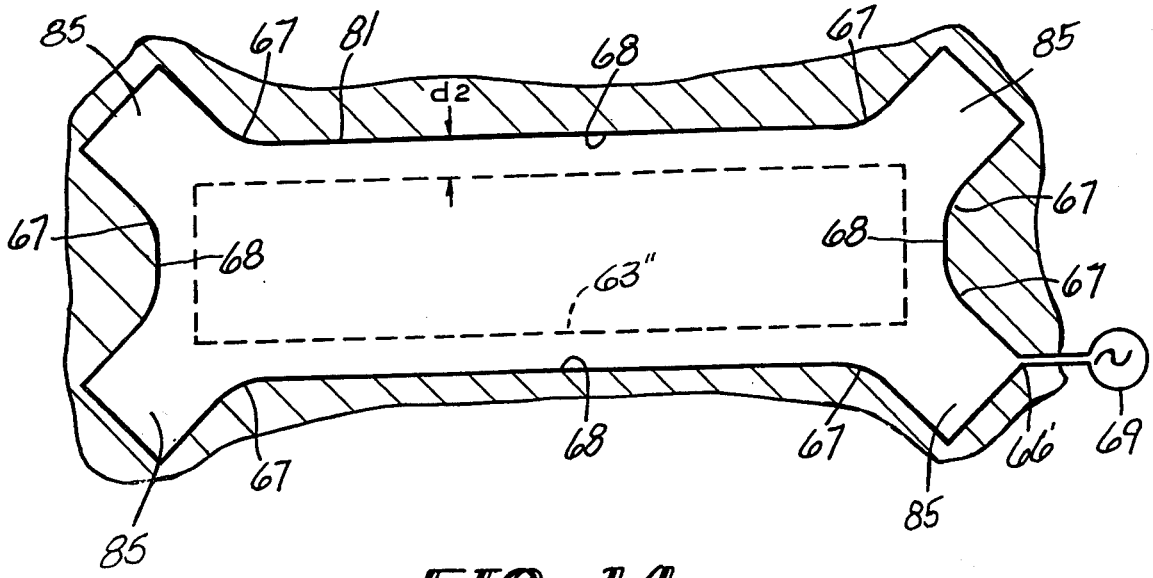
FIG. 14 is a partial top view showing the isoflux line contour for a contoured inductor in accordance with yet another embodiment of this invention.

An analytical approach to the problem of obtaining ingots with small radii corners suggests an inductor from 81 as outlined in FIG. 14. As can now be seen, the inductors 61' and 71 shown in FIGS. 12 and 13 are piecewise linear approximations to the inductor 81 in FIG. 14. The inductor 81 is shown provided with generally rectangular shaped cross-section corners 85 having curved transition sections 67 which join the corners 85 to the sides 68 of inductor 81. This inductor produces a containment field contour 63'' with nearly ideal corners. The actual curvature of the inductor is basically a function of desired ingot geometry, air gap $d_2$ and the amount of ingot shrinkage.

As stated hereinabove, corners of ingots which have been electromagnetically cast can be characterized by a curve having major and minor radii $R_1$ and $R_2$, respectively. Such an ingot can be utilized to determine the location of the points A–A', which points then serve as the basic points for modification of the inductor. Having determined the location of the points A–A', the points B–B' are then established on the inductor opposite points A–A'.

In the embodiment of FIG. 12, it is desirable to make the value of $d_1$ significantly greater than the value of $d_2$, and at least twice as great as $d_2$. In known electromagnetic casting processes the value of $d_2$ is typically between about ½ and 1½ inches. Thus, the value of $d_1$ in accordance with this invention might range anywhere from about 1 inch to infinity. For practical reasons, a preferred value of $d_1$ would be in the range of 2 to 4 inches. Referring to FIG. 13, having established the location of the points B–B' and the value of $d_1$, the value of $d_3$ becomes set implicitly and is seen to be approximately equal to the distance between the points B–B'.

It should be noted that the optimum contour for a given EM casting process as exemplified by 63, 63', and 63'' in FIGS. 11, 12, and 14, respectively, is embedded into a family of non-optimum contours representing decreasing containment fields toward the interior of the inductor. Contours near the inductor will tend to simulate the shape of the inside perimeter of the inductor while contours further removed from the inside perimeter of the inductor will tend to be elliptic.

Typical EM casting inductors have a height of from approximately ¾ of an inch to 2 inches, and the inductors are typically maintained anywhere from about ½ inch to 1½ inches from the forming ingot surface. The above described techniques for obtaining optimum contours of constant containment fields are most effective when applied to inductors whose heights do not exceed about 10 times the gap between the inner surface of the inductor and the outer surface of the forming ingot.

Accordingly, corner control by inductor shaping can produce ingots with small radii corners, and this procedure constitutes an alternative to using shield shape modifications. However, it should be understood that either method can be used singularly or in concert to produce ingots with improved corner definition.

A further advantage of the inductor shaping procedure of this invention relates to inductor lead connections. Such lead connections are known to cause non-uniformity of field and consequent ingot shape perturbations (U.S. Pat. No. 3,702,155 to Getselev). Such problems are readily solved by making the lead connections at a corner such as corners 66 and 66' as shown in FIGS. 12 and 14, respectively, wherein inductors 61' and 81 in accordance with this invention are shown attached to power sources 69. The increased separation of the lead connections from the ingot surface afforded by this procedure serves to diminish the field non-uniformity so produced to a negligible level.

The novel method and apparatus of the present invention find applicability in the electromagnetic casting of any shapes wherein it is desired to form portions thereon of low radius of curvature.

It is apparent that there has been provided with this invention a novel process and means for utilizing modified inductor contours and/or modified local screening of electromagnetic fields to obtain refinement of ingot shape during electromagnetic casting which fully satisfy the objects, means and advantages set forth hereinabove. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In an apparatus for electromagnetically forming a molten material into a longitudinally extending casting defining a longitudinal axis thereof, an inductor for providing a magnetic containment force field acting on the outer peripheral surface of said molten material, and a magnetic field reducing screen for reducing said magnetic force field, said screen being formed of a non-magnetic metal, said screen comprising a substantially closed loop extending transversely about said longitudinal axis, said screen having at least one portion of small radius of curvature as compared to adjacent transversely extending portions, said screen having a uniform transverse cross-section, and said screen having locally deeper displacement in the direction of said longitudinal axis at said at least one portion as compared to portions of said screen adjacent said at least one portion.

2. In an apparatus for electromagnetically forming a molten material into a longitudinally extending casting defining a longitudinal axis thereof, an inductor for providing a magnetic containment force field acting on the outer peripheral surface of said molten material, and a magnetic field reducing screen for reducing said magnetic force field, said screen being formed of a non-magnetic metal, said screen comprising a substantially closed loop extending transversely about said longitudinal axis, said screen having at least one portion of small radius of curvature as compared to adjacent transversely extending portions, said screen having a locally changing transverse cross-section in the direction of said longitudinal axis at said at least one portion as compared to portions of said screen adjacent said at least one portion.

3. A screen as in claim 2 wherein said screen has a locally deeper displacement of said screen in the direction of the longitudinal axis at said at least one portion as compared to portions of said screen adjacent said at least one portion.

4. A screen as in claim 2 wherein said screen has a thicker transverse cross-section at a bottom end of the screen at said at least one portion as compared to portions of said screen at said bottom end adjacent said at least one portion.

5. In an apparatus for electromagnetically forming a molten material into a longitudinally extending casting defining a longitudinal axis thereof, an inductor for providing a magnetic containment force field acting on the outer peripheral surface of said molten material, and a magnetic field reducing screen for reducing said magnetic force field, said screen comprising a closed loop of a non-magnetic metal extending transversely about said longitudinal axis and having at least one portion of small radius of curvature as compared to adjacent transversely extending portions, said screen being formed of an inclined member of constant section having a locally changing orientation with respect to said longitudinal axis at said at least one portion as compared to portions of said screen adjacent said at least one portion, said locally changing orientation comprising a variation in the angle of inclination of said screen with respect to the longitudinal axis thereof.

6. A screen as in any of claims 1, 2 or 5 wherein said loop is of a rectangular configuration and said at least one portion of small radius of curvature comprises the corners of said screen.

* * * * *